US007775690B2

(12) United States Patent
Wakalopulos

(10) Patent No.: US 7,775,690 B2
(45) Date of Patent: Aug. 17, 2010

(54) GAS COOLED REFLECTOR STRUCTURE FOR AXIAL LAMP TUBES

(75) Inventor: George Wakalopulos, Pacific Palisades, CA (US)

(73) Assignee: Adastra Technologies, Inc., Torrance, CA (US)

( * ) Notice: Subject to any disclaimer, the term of this patent is extended or adjusted under 35 U.S.C. 154(b) by 163 days.

(21) Appl. No.: 12/112,753

(22) Filed: Apr. 30, 2008

(65) Prior Publication Data

US 2009/0273936 A1 Nov. 5, 2009

(51) Int. Cl.
*F21V 7/00* (2006.01)

(52) U.S. Cl. ..... 362/346; 362/341; 362/345; 362/297; 362/294; 250/504 R; 250/492.1

(58) Field of Classification Search ..... 362/345, 362/346
See application file for complete search history.

(56) References Cited

U.S. PATENT DOCUMENTS 3,819,929 A * 6/1974 Newman ..... 362/218
5,003,185 A 3/1991 Burgio, Jr.
5,861,633 A * 1/1999 Mandellos ..... 250/504 R
6,739,716 B2 5/2004 Richards
6,883,936 B2 * 4/2005 Register et al. ..... 362/284
7,002,170 B2 * 2/2006 Schweitzer ..... 250/504 R
7,411,202 B2 * 8/2008 Hasenour et al. ..... 250/504 R
2007/0017503 A1 * 1/2007 Hasenour et al. ..... 126/605

* cited by examiner

*Primary Examiner*—Laura Tso
(74) *Attorney, Agent, or Firm*—Schneck & Schneck; Thomas Schneck

(57) ABSTRACT

A light weight reflector structure for an axial UV lamp wherein a shell-like channel housing supporting spaced apart ribs that in turn support flexed reflective spars that take the shape of the ribs. A preferred shape for the ribs and spars is parabolic about the axial UV lamp so that a beam is formed and directed out of the channel housing. The spars have a gap partially blocked by a deflector spar for creating a tortuous path for air forced direct into a tunnel between the channel housing and the spars. Forced air swirls through the gap and cools both the lamp and the spars.

28 Claims, 7 Drawing Sheets

GAS COOLED REFLECTOR STRUCTURE FOR AXIAL LAMP TUBES

TECHNICAL FIELD

The invention relates to portable and mobile reflectors for elongated lamps, particularly ultraviolet lamps.

BACKGROUND ART

Ultraviolet (UV) lamps are known for curing inks, adhesives, paint and similar coatings. Normally, such coatings would require hours to dry and harden but UV light usually causes molecular cross-linking and hardening within a few seconds. Because these coatings are usually applied to two-dimensional surfaces, it is advantageous to scan the surfaces with a UV beam tube that has a lengthwise or linear axial extent similar to a fluorescent tube so that the surface can be scanned in a series of parallel adjacent stripes. To concentrate the emission of such a linear tube, a parabolic or elliptical housing is used to reflect light from the tube over an extent that can be as narrow as a line for maximum concentration or a stripe parallel to the tube for a more useful surface scanning concentration.

In U.S. Pat. No. 6,739,716 to D. Richards, a UV lamp axial tube is shown having a reflector with two symmetrical parts on opposite sides of the tube. The reflector can focus UV light to a desired position such as a stripe of variable width.

One of the problems occurring with UV lamp axial tube reflectors is that both the lamps and reflectors reach high temperatures because the reflectors are used in closed proximity to surfaces being treated. Under such circumstances, heat can be trapped within the reflector causing a risk of burning the surface being treated or deformation of the lamp tube or the reflector itself.

In U.S. Pat. No. 5,003,185 to Burgio, Jr. a reflector assembly for a tube is shown to have both an air and water conduit extending through a reflector block for cooling purposes. Air is driven by blowers through ports in the reflector structure, while water is used to remove heat from the block. While this heat removal structure is useful, it is more suited to fixed positioning where a surface to be treated moves past the reflector structure.

A problem that has occurred in recent years is that graffiti is ubiquitous in certain urban areas. Graffiti abatement often consists of applying solvents, paint or other coatings to dissolve or cover the graffiti. Such surface treatments require curing assemblies of the prior art are not adapted for portable use.

An object of the invention was to devise a reflector structure for UV lamp axial tubes that was sufficiently light weight that the reflector could be moved with ease over a wall or surface being treated yet had adequate cooling for safety.

SUMMARY

The above object is achieved with an axial reflector structure for an axial UV lamp tube having both portability and forced air cooling. These features are achieved by using a plurality of thin, spaced apart ribs in a unitary, U-shaped channel housing that is a shell supporting shiny spars that form a reflector for beam formation. Spars are the principal lateral members of a framework that makes up the reflector structure of the present invention. At least one of the spars functions as an air deflector in the channel housing to provide a tortuous path to forced air flow in the housing, introducing swirling and vorticity of air against reflector spars and against the UV beam tube, thereby cooling both without use of water. The deflector spar, which is reflective, is placed rearwardly of the reflector spars so that the reflector is not a simple parabola or ellipse, but has an offset region where a gap is formed in the reflector spars to create the tortuous air flow path into the plenum.

The spars are formed of thin reflective strips having a length similar to the channel housing and the axial beam tube. The thin reflective spars are held in place by the ribs that have an inward shape in cross-section that defines the reflector shape, i.e., parabolic or elliptical. The outward shape of the ribs is designed to fit securely in the channel housing. Between the back side of the spars and the inside wall of the channel housing, a gas flow tunnel is found. Although the spaced apart ribs partially obstruct the tunnel, there is clearance for air flow through ports that are open to outside air through a fan. In other words, the gas flow tunnel is pressurized by fan modules joined to the channel housing that blow air into spaces between ribs, then through the gap in the spars establishing the tortuous air flow path mentioned above.

Air in the gas flow tunnel cools the back walls of the spars while swirling air forced into the plenum cools both the UV lamp and the reflective spars. The light weight channel housing, ribs, spars, lamp, and fan modules make up a portable UV lamp that can be hand held for use against vertical walls, as well as a portable mobile device that can be pushed over horizontal surfaces by a wheeled carriage.

DETAILED DESCRIPTION

Figure 1:
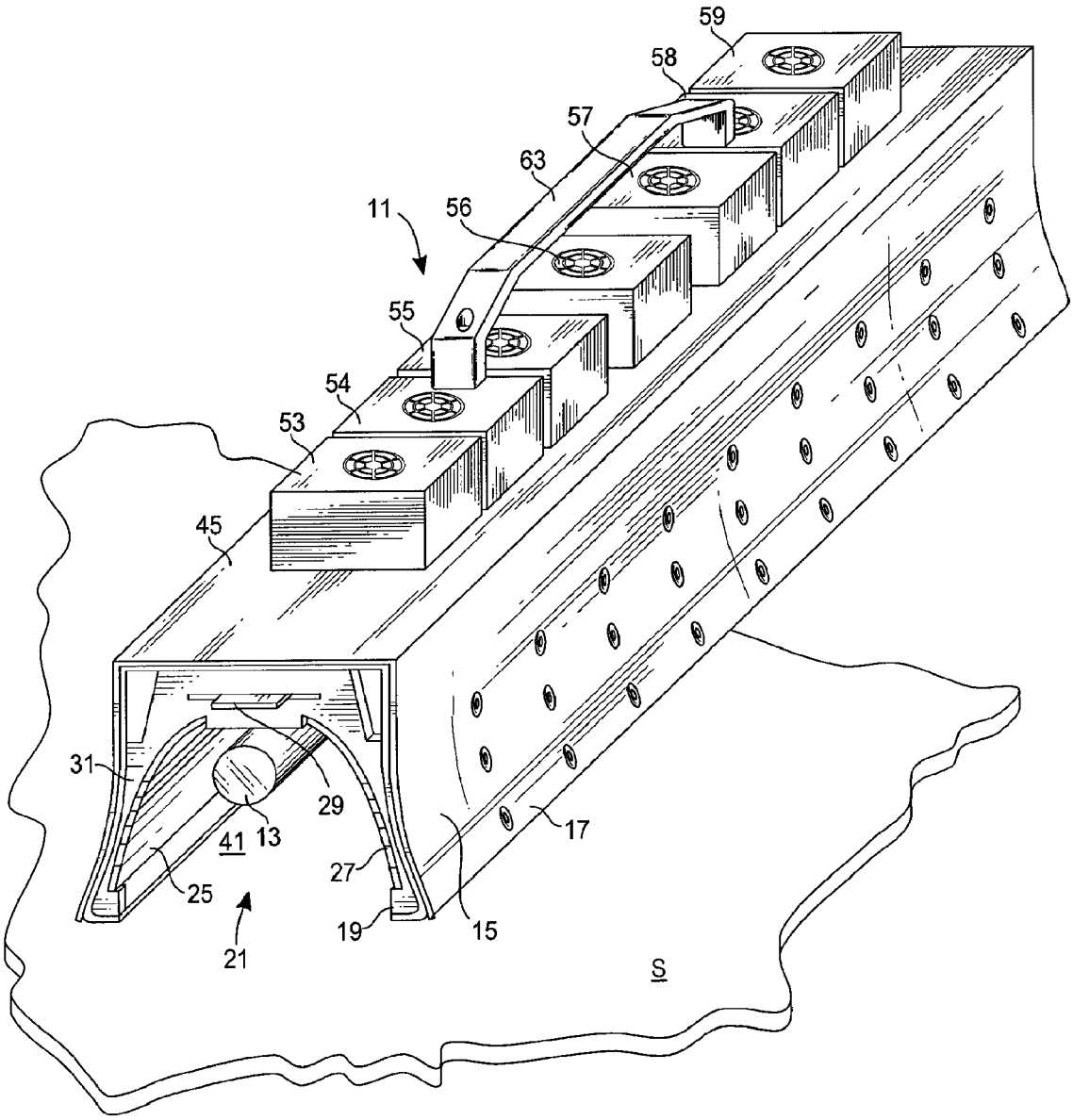
FIG. 1 is a perspective view of a gas cooled reflector structure for axial lamp tubes in accordance with the invention.

With reference to FIG. 1, a gas cooled reflector structure 11 has cross-sectional inverted U-shape with a lengthwise axis. An ultraviolet (UV) lamp tube 13 having a parallel lengthwise axis is mounted within the reflective structure 11. The lamp tube 13 resembles a thin fluorescent tube and operates under similar high voltage conditions.

The reflector structure 11 has three major components, namely an outer channel housing 15, internally spaced apart ribs 31, and shiny reflective spars 25, 27, and 29. Channel housing 15 is seen resting on a work surface W, or held slightly above the work surface, for UV curing of a coating on surface S. An outer wall 17 of channel housing 15 supports a gas flow tunnel 45 having fan modules 53-59 serving as a means for pressurizing the tunnel. The central interior of reflective, where UV lamp tube 13 is located is a plenum 41. Not shown are electrical connections to lamp tube 13, with electrical wiring running through the upper interior of channel housing 15 above the reflective spars. Plenum 41 has an open face towards the work surface, S. UV light from the lamp tube is formed as a beam by means of the reflector structure for delivery to surface W. The channel housing 15 may be supported by a handle 63, keeping the channel housing only a short distance above the work surface. A lower extent of the reflector structure is less than an inch away from the work surface so that a maximum amount of light beam energy is delivered to the work surface. Inks, paint, and coatings of various types may be cured by an ultraviolet radiation beam impinging on the coating. Not shown in FIGS. 1-10 is a high voltage power supply to which the lamp tube is connected. Such power supplies are commercial units that can be provided with long electrical cords for attachment to a lamp tube as used in the embodiments of the invention shown herein. Drying time is cut from a matter of hours to a matter of minutes or seconds.

Figure 2:
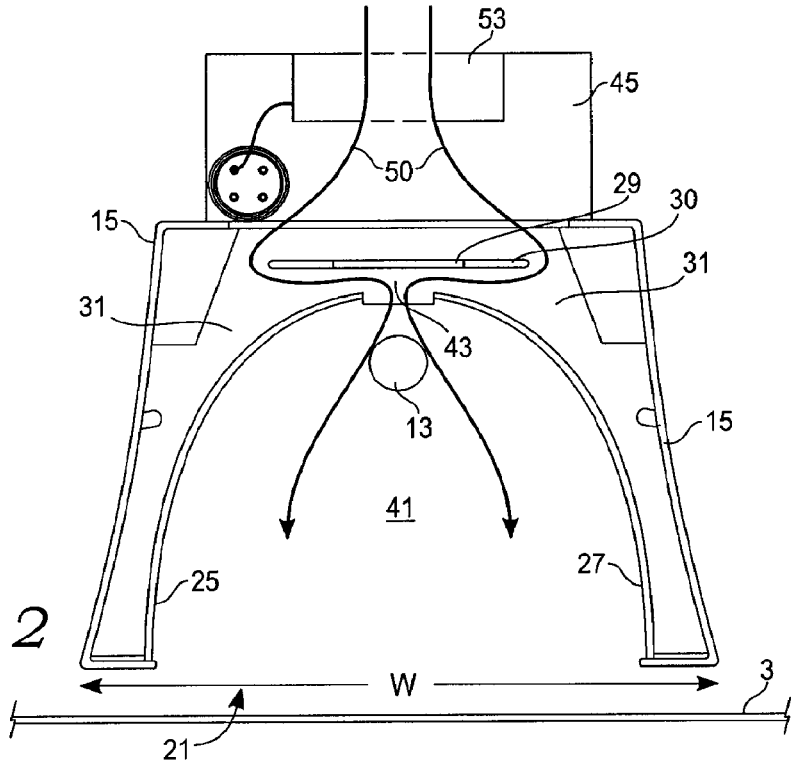
FIG. 2 is a cross sectional view of the reflector structure of FIG. 1.

In FIG. 2, a gap 43 may be seen to exist between the shiny spars 25 and 27, immediately below deflector reflective spar 29. The gap is important for permitting flow of a coolant gas along flow path 50 beginning at a region outside fan 53, through the fan and into gas flow tunnel 45. Note that the deflector spar 29 is supported horizontally by a slot 30 in rib 31 in a location where spar 29 obstructs gas flow through the gap. This causes gas flow around the deflector spar 29 in a tortuous path with vorticity and swirling of air in the gas flow tunnel 45. Because of gas pressure caused by fan 53, gas flows through gap 43 and into the plenum 41 where gas cools the lamp tube 13 as well as shiny spars 25 and 27. Any coolant gas may be used. In an ambient atmosphere of room temperature air, air will work well but other ambient gases will also work.

The shiny spars 25 and 27 are thin gauge metal strips that may be polished aluminum. The strips are initially flat but are flexed in a widthwise direction to take the shape of backing ribs. If the interior shape of the ribs is parabolic, the flexed shape of the spars will also be parabolic. The spars 25 and 27 are symmetric, with gap 43 separating the two spars. If light from the lamp tube 13 passes through gap 43 there is a good chance at angles near the vertical that the light will be reflected back into the plenum towards the work surface. The maximum opening of the plenum is a width dimension, W, that is typically 5 inches or less. This means that the reflector structure of the present invention can be used to treat stripes of a curable material with a stripe having a width W. The length of the stripe depends upon the axial length of the lamp tube and the channel housing.

Figure 3:
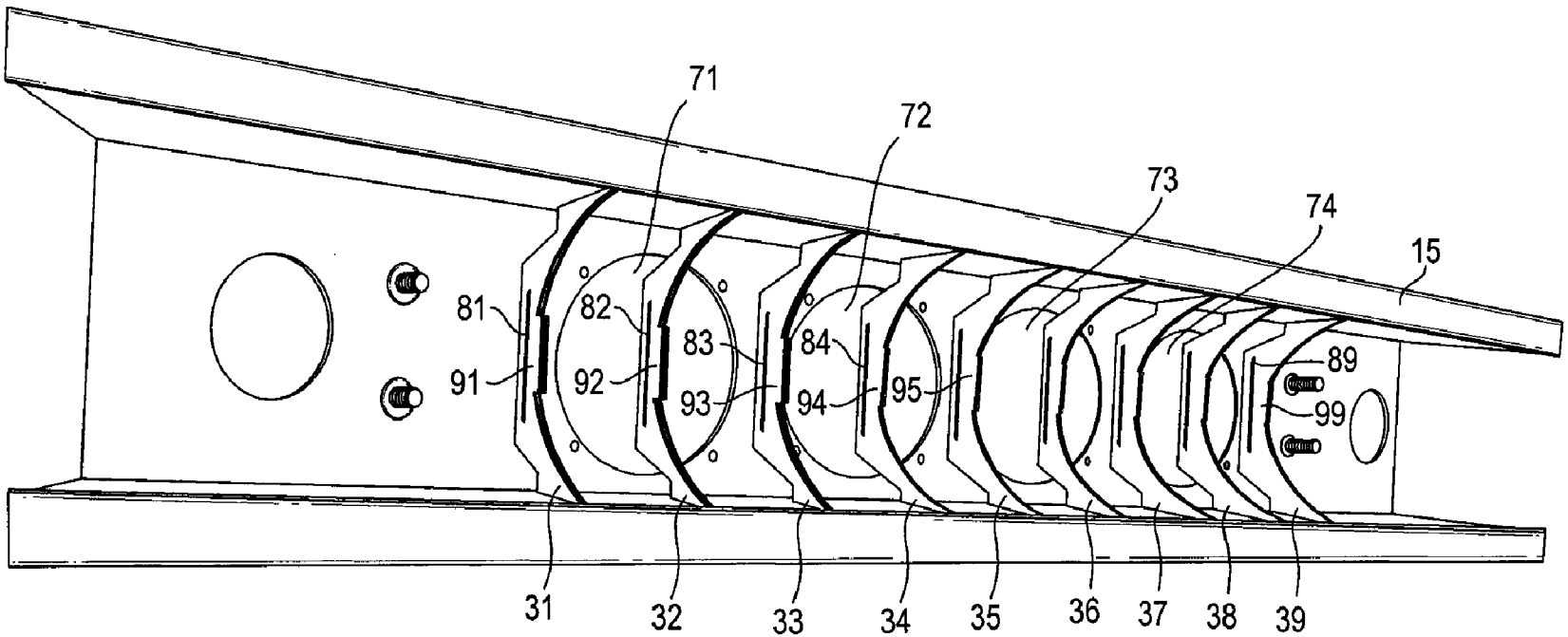
FIG. 3 is a bottom perspective view of a channel housing and ribs of the gas cooled reflector structure of FIG. 1.

With reference to FIG. 3, the U-shaped channel housing 15 is seen to have ribs 31-39 seated in place. The ribs are spaced apart by a distance dividing the channel housing into sections where one rib is in the middle of the air entry ports 71-74, such as rib 34 is in the middle of port 72, and intervening ribs are between ports. In this manner, each section is open to air ingress through a port. The ribs are secured in place by riveting or bonding or any metal joining technique. Note that each of the ribs 31-39 has a slot 81-89 with slots aligned so that a deflector spar can pass through each of the slots upon assembly of the reflector structure. Each spar also has a raised boss 91-99 that serves as abutment for ends of flexed reflective spars. Another abutment may be formed by the outer extent of the channel housing or tangs on the outer extent of the ribs. Each abutment allows a flat spar to be flexed to the parabolic shape of the inward curvature of the ribs and snap into place. This may be seen more clearly in FIGS. 4 and 5.

Figure 4:
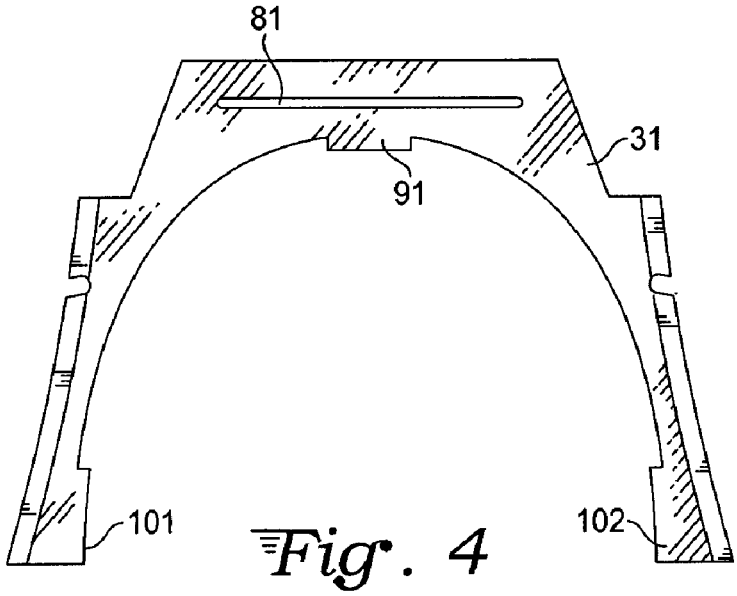
FIG. 4 is a side elevational view of a rib illustrated in FIG. 3.
Figure 5:
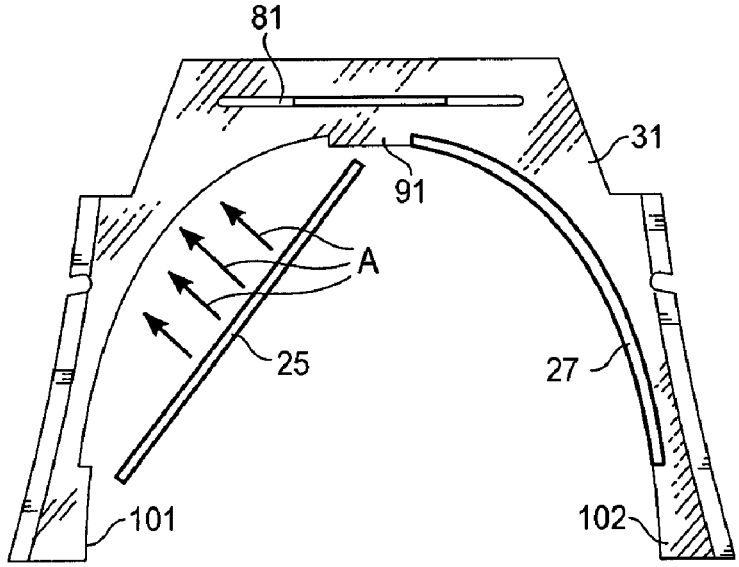
FIG. 5 is a side elevational view of the rib shown in FIG. 4 with a pair of reflective spars in place.

In FIG. 4, rib 31 has slot 81 for allowing a deflector spar to pass through. The raised boss 91 serves as an edge stop for two reflective spars held in place by tangs 101 and 102. In FIG. 5, the shiny reflective spar 25 is about to be snapped in place in the direction of arrows A by the raised boss 91 and the tang 101. Spar 27 is already in place.

Figure 6:
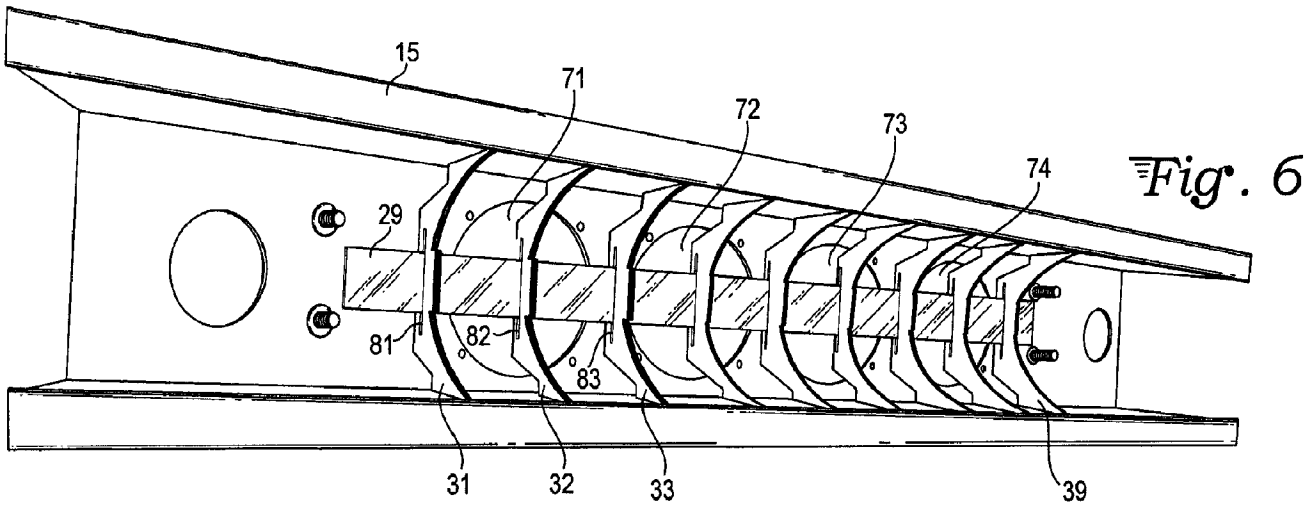
FIG. 6 is a bottom view as in FIG. 3 with a deflector spar in place.

FIG. 6 is similar to FIG. 3 except that the shiny deflector spar 29 has been seated through the slots 81-89 in each of the ribs 31-39. The deflector spar will deflect incoming air through the air entry ports 71-74, causing vorticity and swirling of air as air under pressure meets flow resistance and deflection as shown in FIG. 2 by the air flow path 50.

Figure 7:
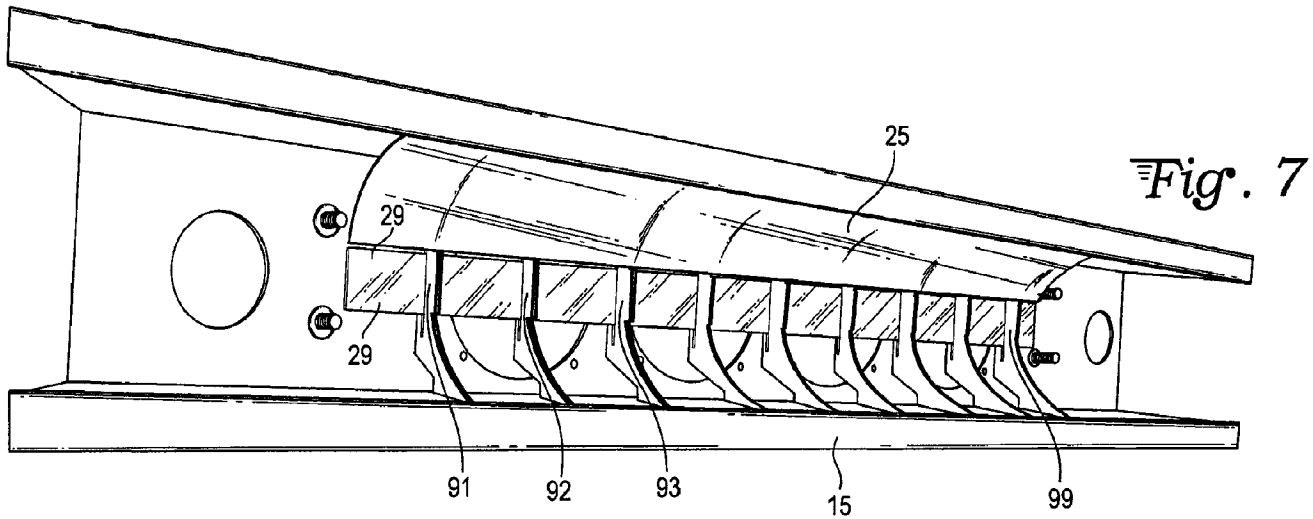
FIG. 7 is a bottom view as in FIG. 6 with a single reflector spar in place as well as a deflector spar.

FIG. 7 is similar to FIG. 6 except that one of the reflective spars 25 has been seated against raised bosses 91-99 on the one hand and rib tangs, not shown, near the open face of the channel housing 15 on the other hand. As mentioned above, the reflector spar 25 is a flat strip of shiny metal which is retained in place by the ribs after flexing the strip in the axial direction so that each spar is retained between the raised bosses 91-99 and tangs on outer edges of the ribs.

Figure 8:
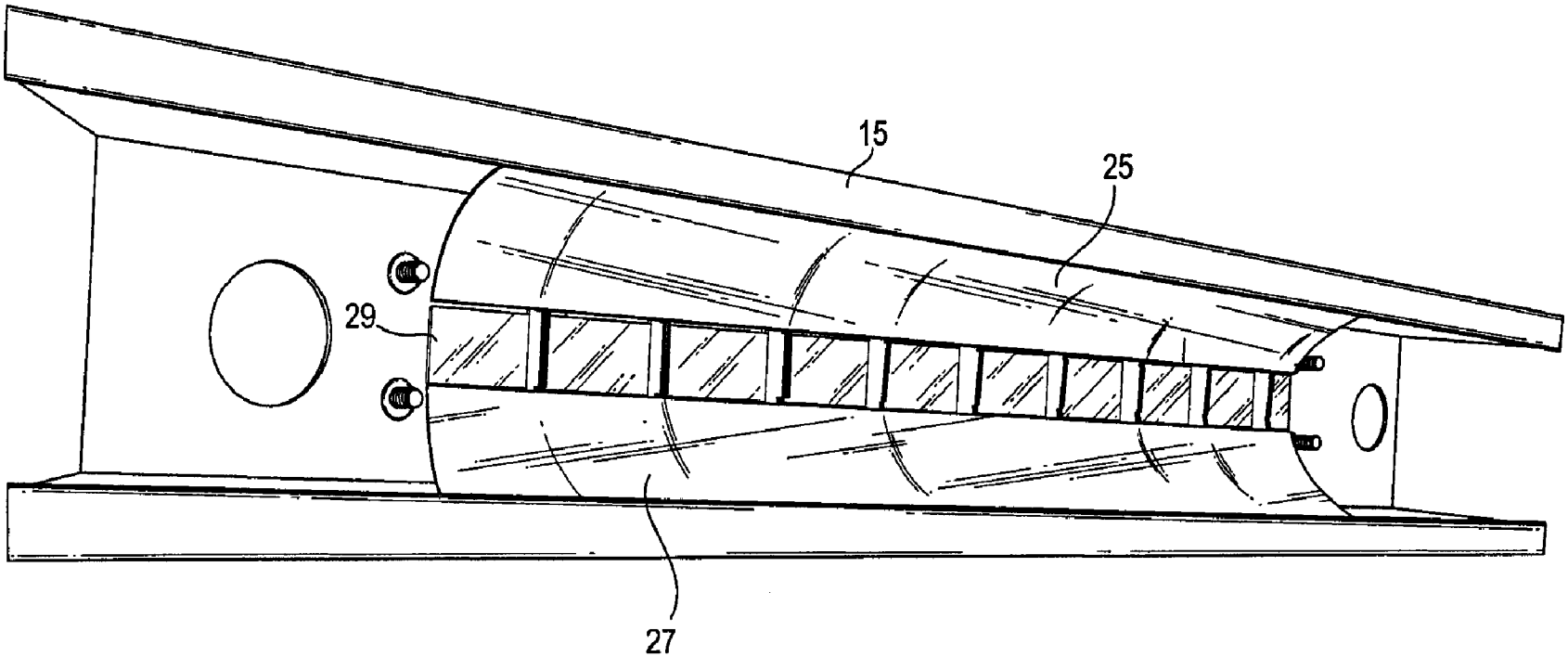
FIG. 8 is a bottom view as in FIG. 7 with two reflector spars in place as well as a deflector spar.

Preferably the spars assume a parabolic or elliptical shape so that the reflective spars have a beam forming characteristic. A parabolic shape, with the beam tube placed at the axis of the parabolic shape will cause approximately parallel light rays to pass out of the channel housing. Moving the beam tube away from the central axial location in the channel housing, either closer to the work surface or away from the work surface, causes the output beam to have different focal characteristics that are shown in the art. By having the shiny reflective deflector spar 29 behind the gap formed by the two reflector spars, two affects are achieved. First, air is forced to circulate in a tortuous path described above. Secondly, the reflective character of the deflector spar causes light traveling into the gap to be reflected back into the plenum beyond the gap and become part of the beam so that not all light passing into the gap is lost. Some light, particularly at angles perpendicular to the deflector spar is not lost. With reference to FIG. 8, reflective spars 25 and 27 are shown in place. Auxiliary deflector spar 29 is shown to be outside of the plenum in channel housing 15, slightly behind the reflector spars 25 and 27.

Figure 9:
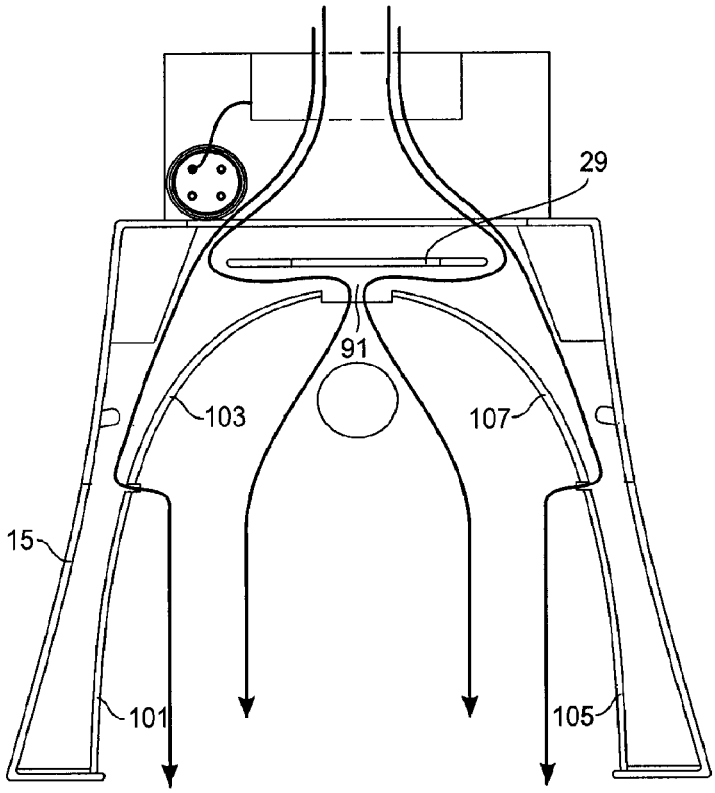
FIG. 9 is an alternate embodiment of the reflector structure shown in FIG. 2.

With reference to FIG. 9, a channel housing 15 is shown to have two pair of reflector spars, namely 101 and 103 on one side of the raised boss 91 and spars 105 and 107 on the opposite side. The present invention is not limited to a pair of reflective spars on either side of boss 91, but they employ any number of spars which work in combination with the auxiliary deflecting spar 29.

Figure 10:
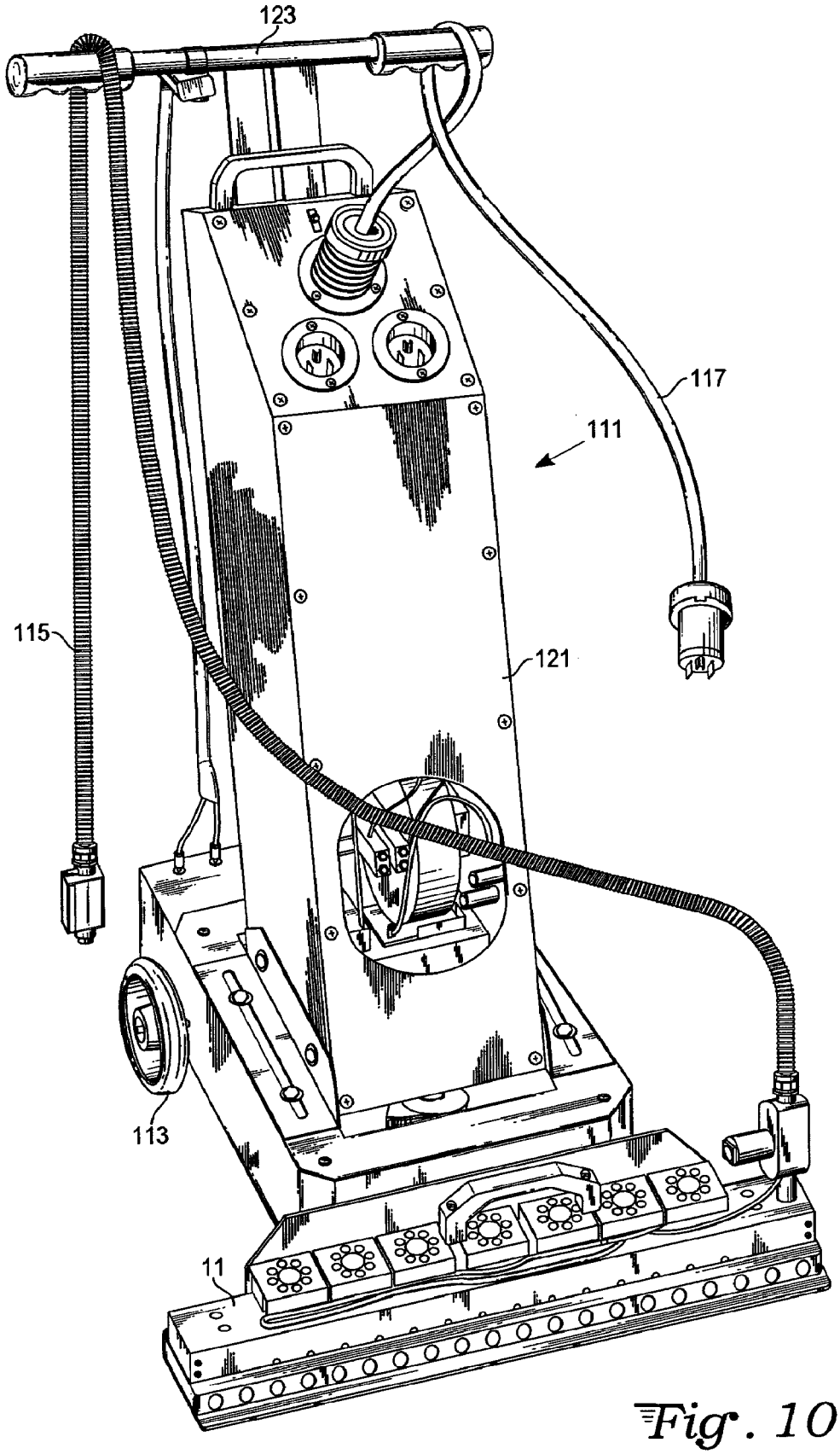
FIG. 10 is a perspective view of a wheeled carriage employing the reflector structure shown in FIG. 1.

With regard to FIG. 10, a reflector structure 11 is seen to be mounted in a wheeled frame 111 having rear wheels 113, as well as a forward wheel, not shown. The wheels support the channel housing 11 in a ground clearance relation with less than an inch clearance from a work surface. An external conduit 115 can bring high voltage into the channel housing to supply the high voltage beam tube. Local current from an AC line 117 provides electricity for powering motors that drive the frame. The frame has an upright body 121 with a handle 123 at the top of the body for steering the apparatus which has the approximate shape and size of an upright vacuum cleaner. Channel housing 111 is moved over surfaces to be cured by pushing and pulling the frame so that light from the lamp tube reaches desired locations.

What is claimed is:

1. A reflector structure for directing radiation from an axial beam tube toward a work surface comprising:

a channel housing with outer and inner walls and with a length having a cross-sectional open face towards a work surface and having a plurality of spaced apart ribs supported within the inner wall of the channel housing with a cross-sectional open face of each of the ribs aligned with the open face of the channel housing along its length;

a plurality of shiny spars disposed along the length of the inner walls of the channel housing supported by the ribs forming a plenum wherein a high power lamp tube is mounted, the spars forming an optical reflector for the lamp tube with a gap between two adjacent spars, with the spars and inner channel wall defining a gas flow tunnel outside of the plenum;

an auxiliary deflector spar located behind the plurality of shiny spars between the gap and the inner wall of the channel housing within the gas flow tunnel partially obstructing the gap between the shiny spars; and means for pressurizing the tunnel with a coolant gas in a manner causing gas flow against the auxiliary spar and through the partially obstructed gap creating a tortuous flow path into the plenum between the high power lamp tube and the shiny spars thereby cooling the lamp tube and the shiny spars.

2. A reflector structure for directing radiation from an axial beam tube toward a work surface comprising:

a channel housing with outer and inner walls and with a length having a cross-sectional open face towards a work surface and having a plurality of spaced apart ribs supported within the inner wall of the channel housing with a cross-sectional open face of each of the ribs aligned with the open face of the channel housing along its length;

a plurality of shiny spars disposed along the length of the inner walls of the channel housing supported by the ribs forming a plenum wherein a high power lamp tube is mounted, the spars forming an optical reflector for the lamp tube with a gap between two adjacent spars, with the spars and inner channel wall defining a gas flow tunnel outside of the plenum;

an auxiliary spar between the gap and the inner wall of the channel housing within the gas flow tunnel partially obstructing the gap; and means for pressurizing the tunnel with a coolant gas in a manner causing gas flow against the auxiliary spar and through the partially obstructed gap creating a tortuous flow path into the plenum between the high power lamp tube and the shiny spars thereby cooling the lamp tube and the shiny spars wherein the means for pressurizing the tunnel comprises a plurality of fan modules mounted atop the outer wall of the channel housing with the channel housing having apertures accommodating gas flow from the fan modules into the tunnel.

3. The apparatus of claim 1 wherein the cross-sectional open face of the channel housing is less than 5 inches.

4. The apparatus of claim 1 wherein a handle is connected to outer wall of the channel housing.

5. The apparatus of claim 1 wherein the plurality of shiny spars comprises a pair of curved symmetric spars.

6. The apparatus of claim 5 wherein said symmetric spars are parabolic.

7. The apparatus of claim 1 wherein the channel housing is a unitary member.

8. The apparatus of claim 1 wherein the channel housing is a U-shaped member.

9. The apparatus of claim 1 wherein said spars are thin flat strips flexed to conform to the cross-sectional shape of the ribs.

10. The apparatus of claim 1 wherein the coolant gas is air.

11. The apparatus of claim 1 wherein the auxiliary spar is reflective.

12. The apparatus of claim 1 wherein the spaced apart ribs have a parabolic shape.

13. The apparatus of claim 9 wherein the spaced apart ribs have inwardly extending tangs retaining the shiny spars under flex tension.

14. The apparatus of claim 2 wherein the channel housing has an electrical distribution duct outwardly of the outer wall of the channel housing with wiring for the fan modules within the electrical distribution duct.

15. The apparatus of claim 14 wherein the electrical distribution duct supports the fan modules.

16. The A reflector structure for directing radiation from an axial beam tube toward a work surface comprising:

a channel housing with outer and inner walls and with a length having a cross-sectional open face towards a work surface and having a plurality of spaced apart ribs supported within the inner wall of the channel housing with a cross-sectional open face of each of the ribs aligned with the open face of the channel housing along its length;

a plurality of shiny spars disposed along the length of the inner walls of the channel housing supported by the ribs forming a plenum wherein a high power lamp tube is mounted, the spars forming an optical reflector for the lamp tube with a gap between two adjacent spars, with the spars and inner channel wall defining a gas flow tunnel outside of the plenum;

an auxiliary spar between the gap and the inner wall of the channel housing within the gas flow tunnel partially obstructing the gap; and means for pressurizing the tunnel with a coolant gas in a manner causing gas flow against the auxiliary spar and through the partially obstructed gap creating a tortuous flow path into the plenum between the high power lamp tube and the shiny spars thereby cooling the lamp tube and the shiny spars further comprising a wheeled frame supporting the channel housing in ground clearance relation, with the open face of the channel facing the ground.

17. The apparatus of claim 16 wherein the wheeled frame has an upright body rearwardly of the channel housing with a handle at the top of the body, the channel housing being hand removable from the frame.

18. The apparatus of claim 17 wherein the upright body encloses a power supply.

19. The apparatus of claim 16 wherein the wheeled frame has electrically driven wheels.

20. The apparatus of claim 16 wherein the wheeled frame has three wheels.

21. A gas cooled reflector structure for high power lamp tubes comprising:

a channel housing with outer and inner walls and with a length having a cross-sectional open face and having a plurality of spaced apart ribs supported within the inner wall of the channel housing with a cross-sectional open face of each of the ribs aligned with the open face of the channel housing along its length;

a pair of shiny spars oppositely mounted along the length of the inner walls of the channel housing supported by the ribs forming a plenum wherein a high power lamp tube is mounted, the spars forming an optical reflector for the lamp tube with a gap between the spars opposite the open face of the channel and ribs;

an auxiliary deflector spar located behind the pair of shiny spars between the gap and the inner wall of the channel housing partially obstructing the gap between the shiny spars; and means for flowing gas against the auxiliary spar and through the partially obstructed gap creating a tortuous flow path into the plenum between the high power lamp tube and the shiny spars thereby cooling the lamp tube and the shiny spars.

22. The apparatus of claim 21 wherein said pair of spars are parabolic.

23. The apparatus of claim 22 wherein said spars are thin flat strips flexed to conform to the cross-sectional shape of the ribs.

24. The apparatus of claim 21 wherein the auxiliary spar is reflective.

25. The apparatus of claim 21 wherein a handle is connected to outer wall of the channel housing.

26. A gas cooled reflector structure for high power lamp tubes comprising:

a channel housing with outer and inner walls and with a length having a cross-sectional open face and having a plurality of spaced apart ribs supported within the inner wall of the channel housing with a cross-sectional open face of each of the ribs aligned with the open face of the channel housing along its length;

a pair of shiny spars oppositely mounted along the length of the inner walls of the channel housing supported by the ribs forming a plenum wherein a high power lamp tube is mounted, the spars forming an optical reflector for the lamp tube with a gap between the spars opposite the open face of the channel and ribs;

an auxiliary spar between the gap and the inner wall of the channel housing partially obstructing the gap; and means for flowing gas against the auxiliary spar and through the partially obstructed gap creating a tortuous flow path into the plenum between the high power lamp tube and the shiny spars thereby cooling the lamp tube and the shiny spars further comprising a wheeled frame supporting the channel housing in ground clearance relation, with the open face of the channel facing the ground.

27. The apparatus of claim 26 wherein the wheeled frame has an upright body rearwardly of the channel housing with a handle at the top of the body, the channel housing being hand removable from the frame.

28. A reflector structure for directing radiation from an axial beam tube toward a work surface comprising:

a channel housing having a U-shaped cross section with ports for admitting forced air, a lengthwise axis along which an axially disposed lamp tube is mounted in a plenum open towards a work surface and having a peripheral region partially surrounding the lamp tube;

a plurality of spaced apart ribs mounted within the channel housing defining sections each open to at least a portion of a port admitting forced air; and shiny spars mounted to said ribs at the peripheral region of the plenum in a manner reflecting light from the lamp tube toward the work surface, the shiny spars disposed in a beam forming reflective configuration about the beam tube, at least one shiny auxiliary deflector spar mounted behind the periphery of the plenum to deflect forced air admitted through a port between the shiny spars thereby forming a tortuous air flow path for the forced air whereby forced air is directed at both the lamp tube and the shiny spars.

* * * * *